US006208220B1

(12) United States Patent
Logothetis

(10) Patent No.: US 6,208,220 B1
(45) Date of Patent: Mar. 27, 2001

(54) MULTILAYER MICROWAVE COUPLERS USING VERTICALLY-CONNECTED TRANSMISSION LINE STRUCTURES

(75) Inventor: James J. Logothetis, East Stroudsburg, PA (US)

(73) Assignee: Merrimac Industries, Inc., West Caldwell, NJ (US)

( * ) Notice: Subject to any disclaimer, the term of this patent is extended or adjusted under 35 U.S.C. 154(b) by 0 days.

(21) Appl. No.: 09/330,419

(22) Filed: Jun. 11, 1999

(51) Int. Cl.[7] ..... H01P 5/18
(52) U.S. Cl. ..... 333/116; 333/246
(58) Field of Search ..... 333/116, 246

(56) References Cited

U.S. PATENT DOCUMENTS

| | | | | |
|---|---|---|---|---|
| 3,761,843 | | 9/1973 | Cappucci | 333/112 |
| 5,369,379 | * | 11/1994 | Fujiki | 333/116 |
| 5,557,245 | * | 9/1996 | Taketa et al. | 333/116 |
| 5,576,669 | * | 11/1996 | Ruelke | 333/116 |
| 5,841,328 | * | 11/1998 | Hagashi | 333/116 |
| 5,929,729 | * | 7/1999 | Swarup | 333/116 X |

OTHER PUBLICATIONS

Barrett, Robert M., "Microwave Printed Circuits–The Early Years," *IEEE Transactions on Microwave Theory and Techniques*, vol. MTT–32, No. 9, Sep. 1884, pp. 983–990.

Howe, Jr., Harlan, "Microwave Integrated Circuits–An Historical Perspective," *IEEE Transactions on Microwave Theory and Techniques*, vol. MTT–32, No. 9, Sep. 1884, pp. 991–996.

Levy, Ralph, "General Synthesis of Asymmetric Multi–Element Coupled–Transmission–Line Directional Couplers," *IEEE Transactions on Microwave Theory and Techniques*, vol. MTT–11, No. 4, Jul. 1963, pp. 226–237.

Cohn, S.B., "Shielded Coupled–Strip Transmission Line," *IEEE Transactions on Microwave Theory and Techniques*, vol. MTT–3, No. 5, Oct. 1955, pp. 29–38.

Levy, Ralph, "Tables for Asymmetric Multi–Elemenet Coupled–Transmission–Line Directional Couplers," *IEEE Transactions on Microwave Theory and Techniques*, vol. MTT–12, No. 3, May 1964, pp. 275–279.

Crysal, E. G. and Young, L, "Theory and Tables of Optimum Symmetrial TEM–Mode Coupled–Transmission–Line Directional Couplers," *IEEE Transactions on Microwave Theory and Techniques*vol. MTT–13, No. 5, Sep. 1965, pp. 544–558.

Tresselt, C. P., "Design and Computed Theoretical Performance of Three Classes of Equal–Ripple Nonuniform Line Couplers," *IEEE Transactions on Microwave Theory and Techniques*, vol. MTT–17, No. 4, Apr. 1969, pp. 218–230.

Gunston, M. A. R., *Microwave Transmission Line Impedance Data*, Van Nostrand Reinhold Company, 1971, pp. 63–82.

* cited by examiner

*Primary Examiner*—Justin P. Bettendorf
(74) *Attorney, Agent, or Firm*—Chadbourne & Parke LLP; Drew M. Wintringham; Francis G. Montgomery

(57) ABSTRACT

A microwave coupler is constructed in a multilayer, vertically-connected stripline architecture provided in the form of a microwave integrated circuit that has a homogeneous, multilayer structure. Such a coupler has a vertically-connected stripline structure in which multiple sets of stripline layers are separated by interstitial groundplanes, and wherein more than one set of layers has a segment of coupled stripline. A typical implementation operates at frequencies from approximately 0.5 to 6 GHz, although other frequencies are achievable.

16 Claims, 11 Drawing Sheets

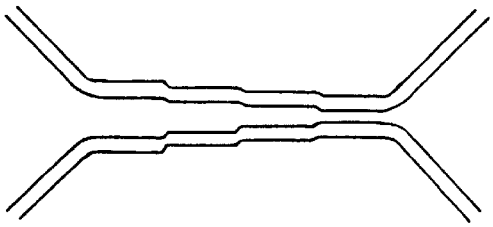
FIG.20
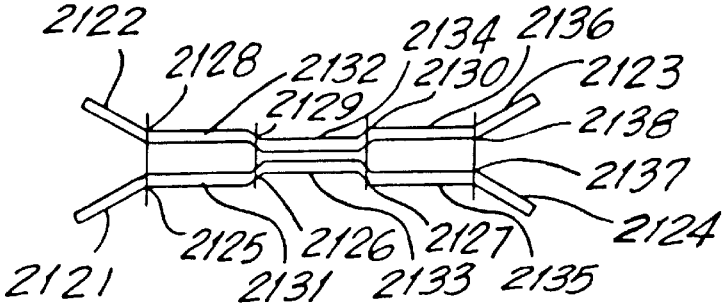
FIG.21
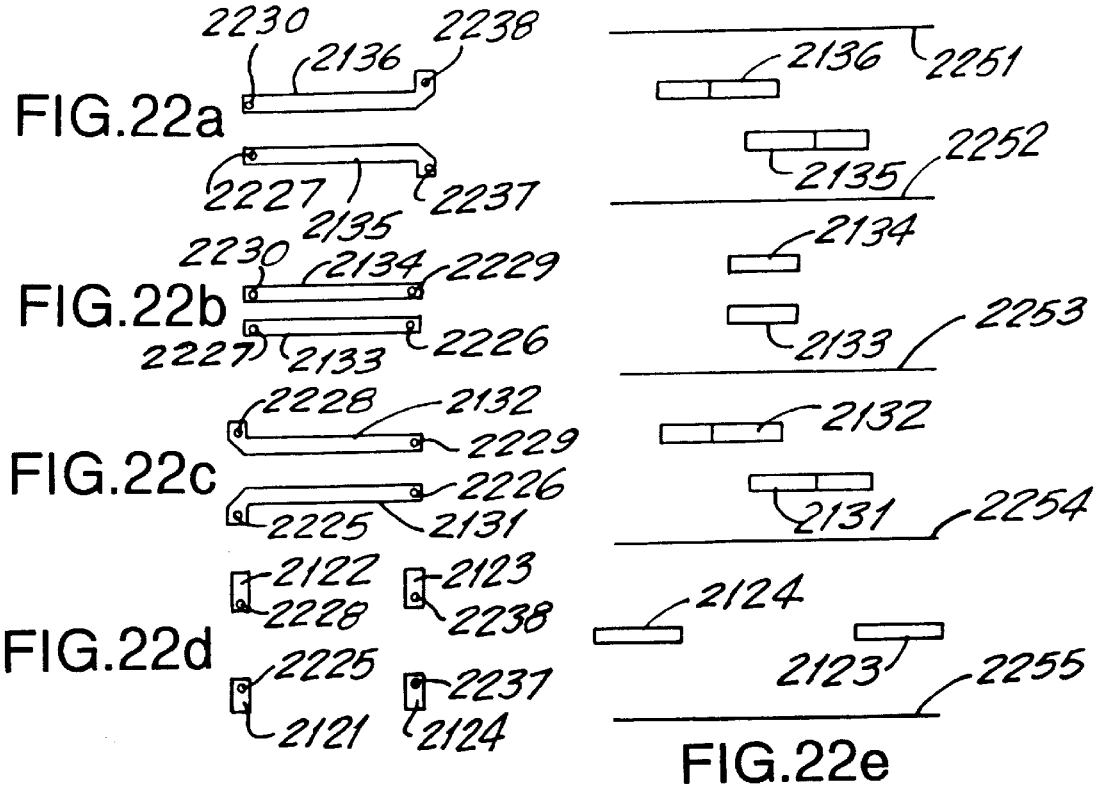

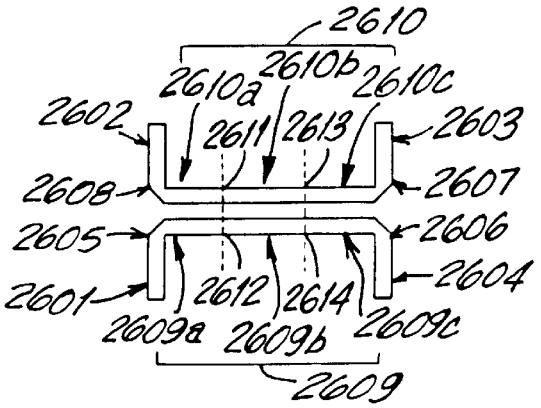
FIG.26
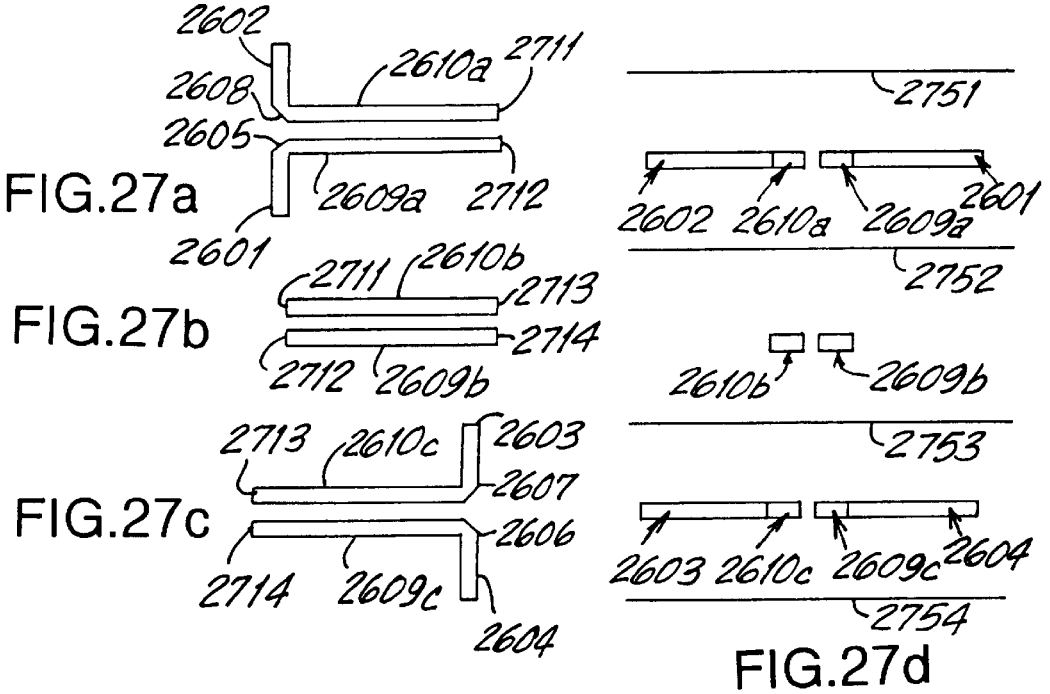
FIG.27a
FIG.27b
FIG.27c
FIG.27d

MULTILAYER MICROWAVE COUPLERS USING VERTICALLY-CONNECTED TRANSMISSION LINE STRUCTURES

FIELD OF THE INVENTION

This invention relates to microwave couplers, such as a coupler constructed in a multilayer, vertically-connected stripline architecture. More particularly, this invention discloses couplers having a vertically-connected stripline structure in which multiple sets of stripline layers are separated by interstitial groundplanes, wherein more than one set of layers has a segment of coupled stripline.

BACKGROUND OF THE INVENTION

Over the decades, wireless communication systems have become more and more technologically advanced, with performance increasing in terms of smaller size and robustness, among other factors. The trend toward better communication systems puts ever-greater demands on the manufacturers of these systems. These demands have driven many developments in microwave technology.

Looking at some of the major developments historically, the early 1950's saw development of planar transmission media, creating a great impact on microwave circuits and component packaging technology. Developments in the engineering of microwave printed circuits and the supporting analytical theories applied to the design of striplines and microstrips contributed to improvements in microwave circuit technology. A historical perspective on some of the developments of microwave integrated circuits and their applications is provided by Howe, Jr., H., "Microwave Integrated Circuits—An Historical Perspective", *IEEE Trans. MIT-S,* Vol. MTT-32, September 1984, pp. 991–996.

The early years of microwave integrated circuit design were devoted mostly to the design of passive circuits, such as directional couplers, power dividers, filters, and antenna feed networks. Despite continuing refinements in the dielectric materials used in the fabrication of such circuits and improvements in the microwave circuit fabrication process, microwave integrated circuit technology was characterized by bulky metal housings and coaxial connectors. The later development of case-less and connector-less couplers helped reduce the size and weight of microwave integrated circuits. These couplers, sometimes referred to as filmbrids, are laminated stripline assemblies that are usually bonded together by fusion or by thermoplastic or thermoset films.

Traditionally, the size of a coupler in the X-Y-plane is governed by the length of the stripline sections being coupled. A coupler designed to perform over wide bandwidths requires additional sections of coupled striplines, which would further increase the overall size of the coupler. Furthermore, since the length of the coupled sections is inversely proportional to the operational frequency of the coupler, a coupler designed to operate at lower frequencies would have longer stripline sections. Coupled lines are often meandered to decrease their effective outline size.

Today, the demands of satellite, military, and other cutting-edge digital communication systems are being met with microwave technology. The growth in popularity of these systems has driven the need for compact, lightweight, and surface-mountable packaging of microwave integrated circuits. Although advances in microwave integrated circuit technology, such as those outlined above, have helped decrease the size, weight and cost of the circuits, it would be advantageous to decrease the size, weight and cost of such circuits even further. In sum, present technologies have limitations that the present invention seeks to overcome.

SUMMARY OF THE INVENTION

The present invention relates to improved microwave couplers which take advantage of novel multilayer, vertically-connected stripline architecture to gain performance benefits over narrow and wide bandwidths while reducing the size and weight of the couplers. Multiple sets of stripline layers are separated by interstitial groundplanes, wherein more than one set of layers has only a segment of coupled stripline.

The vertically-connected stripline structure comprises a stack of dielectric substrate layers preferably having a thickness of approximately 0.002 inches to approximately 0.100 inches, with metal layers, preferably made of copper, which may be plated with tin, with a nickel/gold combination or with tin/lead, between them. Some metal layers form groundplanes, which separate the stack into at least two stripline levels, wherein each stripline level consists of at least one center conducting layer with a groundplane below and a groundplane above, and wherein groundplanes may be shared with other stripline levels. It therefore becomes possible to place segments of a coupler in different stripline levels and connect the segments using plated-through via holes. In this way, couplers are formed on multiple substrate layers by etching and plating copper patterns and via holes on substrates of various thickness and bonding the layers together in a prescribed order.

Preferably, the vertically-connected stripline structure comprises a homogeneous structure having at least four substrate layers that are composites of polytetrafluouroethylene (PTFE), glass, and ceramic. Preferably, the coefficient of thermal expansion (CTE) for the composites are close to that of copper, such as from approximately 7 parts per million per degree C to approximately 27 parts per million per degree C, although composites having a CTE greater than approximately 27 parts per million per degree C may also suffice. Although the substrate layers may have a wide range of dielectric constants such as from approximately 1 to approximately 100, at present substrates having desirable characteristics are commercially available with typical dielectric constants of approximately 2.9 to approximately 10.2.

A means of conduction, such as plated-through via holes, which may have various shapes such as circular, slot, and/or elliptical, by way of example, are used to connect center conducting layers of the stacked stripline structure and also to connect groundplanes. By way of example only, ground slots in proximity to circular via holes carrying signals can form slab transmission lines having a desired impedance for propagation of microwaves in the Z-direction.

Although the vertically-connected stripline structure disclosed typically operates in the range of approximately 0.5 to 6 GHz, other embodiments of the invention can operate at lower and higher frequencies. Furthermore, although the structure disclosed utilizes dielectric material that is a composite of PTFE, glass, and ceramic, the invention is not limited to such a composite; rather, co-fired ceramic or other suitable material may be used.

It is an object of this invention to provide a novel coupler constructed in a multilayer, vertically-connected stripline architecture.

It is another object of this invention to reduce the size and weight of microwave integrated circuits that utilize couplers, by dividing the couplers into segments and arranging the segments on different stripline levels.

It is another object of this invention to reduce the costs of manufacturing microwave integrated circuits that utilize couplers, by dividing the couplers into segments and arranging the segments on different stripline levels, thereby reducing the area of a microwave integrated circuit and allowing more circuits to fit in a given area.

It is another object of this invention to provide an implementation of a broad bandwidth coupler constructed in a multilayer, vertically-connected stripline architecture, by combining a series of uncoupled interconnections with a series of coupled sections.

It is another object of this invention to provide an implementation of a coupler capable of operating over a very wide range of frequencies and having a high pass frequency response, wherein the coupler is constructed in a multilayer, vertically-connected stripline architecture, by connecting non-uniform coupled structures tandem.

BRIEF DESCRIPTION OF THE DRAWINGS

FIG. 20 is the top view of an example of an asymmetrical, four-section coupler implemented with a conventional stripline configuration.

FIG. 21 is the top view of an example of a symmetrical, three-section coupler implemented with a conventional stripline configuration.

FIG. 22*a* is the representative view of an example of a first coupled section of a symmetrical, three section coupler implemented with a vertically-connected stripline configuration.

FIG. 22*b* is the representative view of an example of a second coupled section of a symmetrical, three section coupler implemented with a vertically-connected stripline configuration.

FIG. 22*c* is the representative view of an example of a third coupled section of a symmetrical, three section coupler implemented with a vertically-connected stripline configuration.

FIG. 22*d* is the top view of an example of interface connection transmission lines of a symmetrical, three section coupler implemented with a vertically-connected stripline configuration.

FIG. 22*e* is the end view of an example of stripline metal layers in a symmetrical, three section coupler implemented with a vertically-connected stripline configuration.

FIG. 26 is the top view of an example of an edge-coupler implemented with a conventional stripline configuration.

FIG. 27*a* is the top view of a first coupled segment and interface connection transmission lines of an edge-coupler implemented with a vertically-connected stripline configuration.

FIG. 27*b* is the top view of a second coupled segment of an edge-coupler implemented with a vertically-connected stripline configuration.

FIG. 27*c* is the top view of a third coupled segment and interface connection transmission lines of an edge-coupler implemented with a vertically-connected stripline configuration.

FIG. 27*d* is the end view of an edge-coupler implemented with a vertically-connected stripline configuration.

DETAILED DESCRIPTION OF THE INVENTION

I. Introduction

The vertically-connected stripline structure described herein comprises a stack of substrate layers. A substrate "layer" is defined as a substrate including circuitry on one or both sides. A process for constructing such a multilayer structure is disclosed by U.S. patent application Ser. No. 09/199,675 entitled "Method of Making Microwave, Multifunction Modules Using Fluoropolymer Composite Substrates", filed Nov. 25, 1998, now U.S. Pat. No. 6,099,977 to Logothetis et al., incorporated herein by reference. Note that references to "substrate layer" and "metal layer" herein are often referred to as "layer" and "metalization", respectively, in U.S. patent application Ser. No. 09/199,675.

II. Multilayered Structure

Figure 1A:
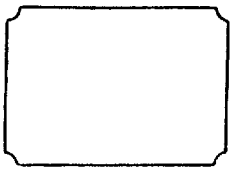
FIG. 1*a* is a top view of a multilayer structure for preferred embodiments of the invention.
Figure 1B:
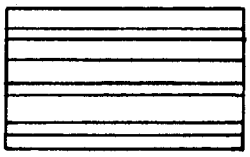
FIG. 1*b* is a side view of a multilayer structure or possible embodiments of the invention.

A stack of substrate layers, in which each substrate layer typically has one or two metal layers etched onto the surface, are bonded to form a multilayer structure. A multilayer structure may have a few or many substrate layers. Referring to FIGS. 1*a* and 1*b*, the typical outline dimensions of a preferred embodiment having eight substrate layers is shown. In this particular embodiment, the multilayer structure 100 is approximately 0.280 inches in the x-direction, approximately 0.200 inches in the y-direction, and approximately 0.100 to approximately 0.165 inches thick in the z-direction.

In a preferred embodiment, a substrate layer is approximately 0.002 inches to 0.100 inches thick and is a composite of PTFE, glass, and ceramic. It is known to those of ordinary skill in the art of multilayered circuits that PTFE is a preferred material for fusion bonding while glass and ceramic are added to alter the dielectric constant and to add stability. Substitute materials may become commercially available. Thicker substrate layers are possible, but result in physically larger circuits, which are undesirable in many applications. Preferably, the substrate composite material has a CTE that is close to that of copper, such as from approximately 7 parts per million per degree C to approximately 27 parts per million per degree C, although composites having a CTE greater than approximately 27 parts per million per degree C may also suffice. Typically, the substrate layers have a relative dielectric constant (Er) in the range of approximately 2.9 to approximately 10.2. Substrate layers having other values of Er may be used, but are not readily commercially available at this time.

Metal layers are formed by metalizing substrate layers with copper, which is typically 0.0002 to 0.0100 inches thick and is preferably approximately 0.0007 inches thick, and are connected with via holes, preferably copper-plated, which are typically circular and 0.005 to 0.125 inches in diameter, and preferably approximately 0.008 to 0.019 inches in diameter. Substrate layers are preferably bonded together directly (as described in greater detail in the steps outlined below) using a fusion process having specific temperature and pressure profiles to form multilayer structure 100, containing homogeneous dielectric materials. However, alternative methods of bonding may be used, such as methods using thermoset or thermoplastic bonding films, or other methods that are obvious to those of ordinary skill in the art. The fusion bonding process is known to those of ordinary skill in the art of manufacturing multilayered polytetrafluoroethylene ceramics/glass (PTFE composite) circuitry. However, a brief description of an example of the fusion bonding process is described below.

Fusion is accomplished in an autoclave or hydraulic press by first heating substrates past the PTFE melting point. Alignment of layers is secured by a fixture with pins to stabilize flow. During the process, the PTFE resin changes state to a viscous liquid, and adjacent layers fuse under pressure. Although bonding pressure typically varies from approximately 100 PSI to approximately 1000 PSI and bonding temperature typically varies from approximately 350 degrees C. to 450 degrees C., an example of a profile is 200 PSI, with a 40 minute ramp from room temperature to 240 degrees C., a 45 minute ramp to 375 degrees C., a 15 minutes dwell at 375 degrees C., and a 90 minute ramp to 35 degrees C.

It is to be appreciated that other dielectric materials or co-fired ceramic, or other material whose use in multilayered circuitry is obvious to those of ordinary skill in the art, may be used.

Figure 2:
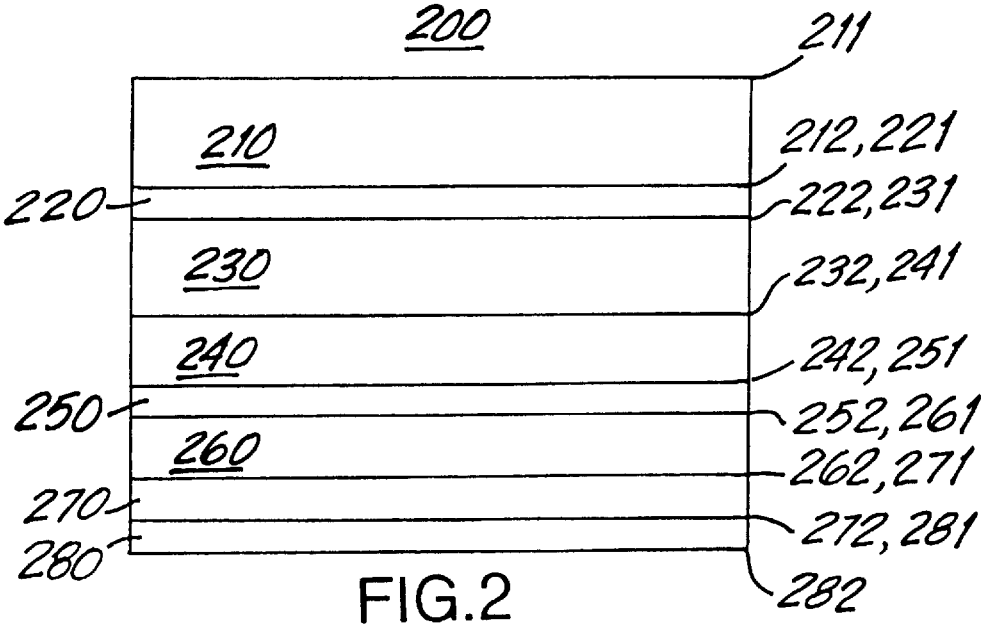
FIG. 2 is the profile for a multilayer structure having a possible embodiment of a quadrature 3 dB coupler.
Figure 3:
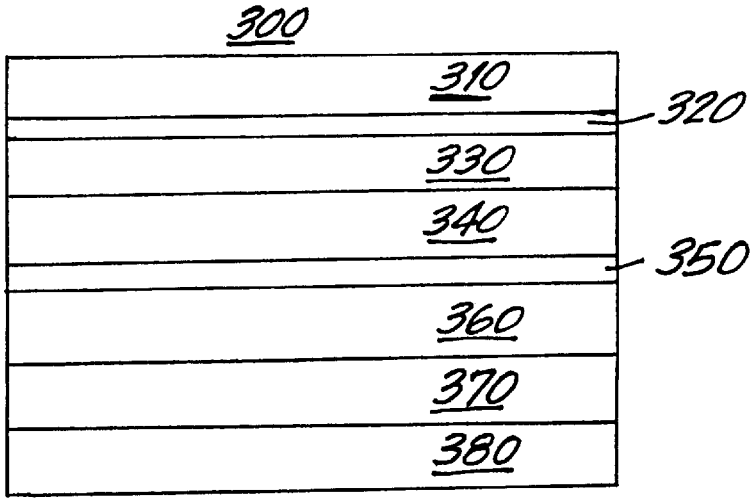
FIG. 3 is the profile for a multilayer structure having a possible embodiment of a directional 10 dB coupler.

Multilayer structure 100 may be used to fabricate useful circuits, such as the quadrature 3 dB coupler circuit of multilayer structure 200 shown in FIG. 2 or the directional 10 dB coupler circuit of multilayer structure 300 shown in FIG. 3. The coupler circuits of multilayer structure 200 and multilayer structure 300 constitute two possible embodiments of the invention. However, it is to be appreciated that other circuits may be fabricated utilizing the general structure of multilayer structure 100, and that a smaller or larger number of layers may be used. It is also to be appreciated that one of ordinary skill in the art of designing via holes may design via holes of different shapes, such as slot or elliptical, and/or diameters than those presented here. The following provides an example of the manufacture of a quadrature 3 dB coupler. It is obvious to those of ordinary skill in the art that other couplers having vertically-connected stripline structure may be manufactured using a similar manufacturing process.

III. Example of Manufacture of a Preferred Embodiment for a Quadrature 3 dB Coupler A side profile for multilayer structure 200 having a preferred embodiment of a quadrature 3 dB coupler is shown in FIG. 2. Substrate layers 210, 220, 230, 240, 250, 260, 270, 280 are approximately 0.280 inches in the x-direction, approximately 0.200 inches in the y-direction, and have an Er of approximately 3.0. Substrate layer 210 has an approximate thickness of 0.030 and is metalized with metal layers 211, 212. Substrate layer 220 has an approximate thickness of 0.005 and is metalized with metal layers 221, 222. Substrate layer 230 has an approximate thickness of 0.030 and is metalized with metal layers 231, 232. Substrate layer 240 has an approximate thickness of 0.030 and is metalized with metal layers 241, 242. Substrate layer 250 has an approximate thickness of 0.005 and is metalized with metal layers 251, 252. Substrate layer 260 has an approximate thickness of 0.030 and is metalized with metal layers 261, 262. Substrate layer 270 has an approximate thickness of 0.015 and is metalized with metal layers 271, 272. Substrate layer 280 has an approximate thickness of 0.015 and is metalized with metal layers 281, 282. Metal layers 211, 212, 221, 222, 231, 232, 241, 242, 251, 252, 261, 262, 271, 272, 281, 282 are typically approximately 0.0007 inches thick each.

It is to be appreciated that the numbers used (by way of example only, dimensions, temperatures, time) are approximations and may be varied, and it is obvious to one of ordinary skill in the art that certain steps may be performed in different order.

Figure 11A:
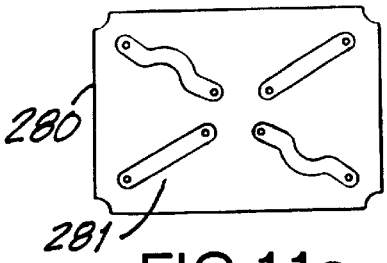
FIG. 11*a* is the top view of the eighth substrate layer of a multilayer structure for a quadrature 3 dB coupler.
Figure 11B:
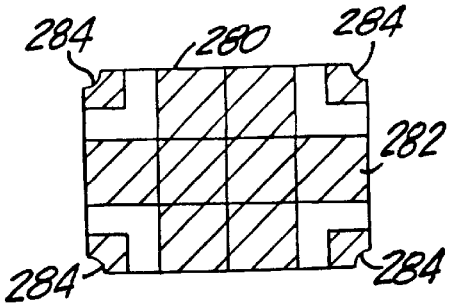
FIG. 11*b* is the bottom view of the eighth substrate layer of a multilayer structure for a quadrature 3 dB coupler.

It is also to be appreciated that some of the figures show corner holes in the layers that do not exist until all the layers are bonded together and corner holes 284 as shown in FIG. 11*b* are drilled in multilayer assembly 200.

It is also to be appreciated that typically hundreds of circuits are manufactured at one time in an array on a substrate panel. Thus, a typical mask may have an array of the same pattern.

a. Layer 210

Figure 4A:
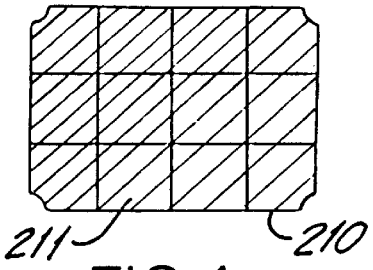
FIG. 4*a* is the top view of the first substrate layer of a multilayer structure for a quadrature 3 dB coupler.
Figure 4B:
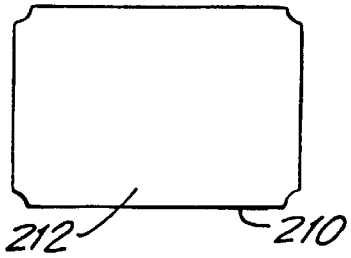
FIG. 4*b* is the bottom view of the first substrate layer of a multilayer structure for a quadrature 3 dB coupler.

With reference to FIGS. 4*a* and 4*b*, the process for manufacturing layer 210 is described. Layer 210 is heated to a temperature of approximately 90 to 125 degrees C. for approximately 5 to 30 minutes, but preferably 90 degrees C. for 5 minutes, and then laminated with photoresist. A mask is used and the photoresist is developed using the proper exposure settings to create the patterns of metal layer 212 shown in FIG. 4*b*. The bottom sides of layer 210 is copper etched. Layer 210 is cleaned by rinsing in alcohol for 15 to 30 minutes, then preferably rinsing in water, preferably deionized, having a temperature of 70 to 125 degrees F. for at least 15 minutes. Layer 210 is then vacuum baked for approximately 30 minutes to 2 hours at approximately 90 to 180 degrees C., but preferably for one hour at 149 degrees C.

b. Layer 220

Figure 5A:
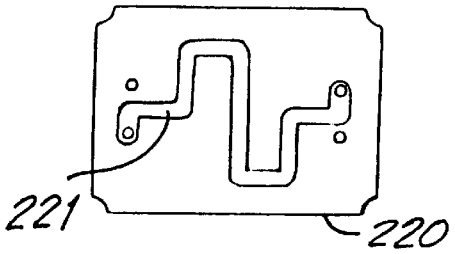
FIG. 5*a* is the top view of the second substrate layer of a multilayer structure for a quadrature 3 dB coupler.
Figure 5B:
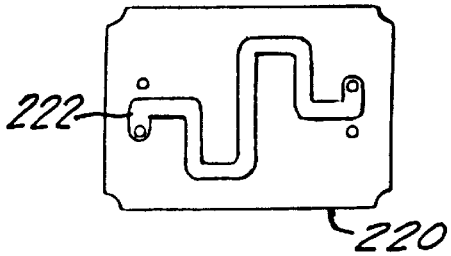
FIG. 5*b* is the bottom view of the second substrate layer of a multilayer structure for a quadrature 3 dB coupler.

With reference to FIGS. 5*a* and 5*b*, the process for manufacturing layer 220 is described. First, four holes each having a diameter of approximately 0.008 inches are drilled into layer 220 as shown in FIGS. 5*a* and 5*b*, and in greater detail in FIG. 14. Layer 220 is sodium or plasma etched. If sodium etched, layer 220 is cleaned by rinsing in alcohol for 15 to 30 minutes, then preferably rinsing in water, preferably deionized, having a temperature of 70 to 125 degrees F. for at least 15 minutes. Layer 220 is then vacuum baked for approximately 30 minutes to 2 hours at approximately 90 to 180 degrees C., but preferably for one hour at 100 degrees C. Layer 220 is plated with copper, preferably first using an electroless method followed by an electrolytic method, to a thickness of approximately 0.0005 to 0.001 inches, but preferably 0.0007 inches thick. Layer 220 is rinsed in water, preferably deionized, for at least 1 minute. Layer 220 is heated to a temperature of approximately 90 to 125 degrees C. for approximately 5 to 30 minutes, but preferably 90 degrees C. for 5 minutes, and then laminated with photoresist. Masks are used and the photoresist is developed using the proper exposure settings to create the patterns of metal layers 221, 222 shown in FIGS. 5*a* and 5*b*, and in greater detail in FIG. 14. Both sides of layer 220 are copper etched. Layer 220 is cleaned by rinsing in alcohol for 15 to 30 minutes, then preferably rinsing in water, preferably deionized, having a temperature of 70 to 125 degrees F. for at least 15 minutes. Layer 220 is then vacuum baked for approximately 30 minutes to 2 hours at approximately 90 to 180 degrees C., but preferably for one hour at 149 degrees C.

c. Layer 230

Figure 6A:
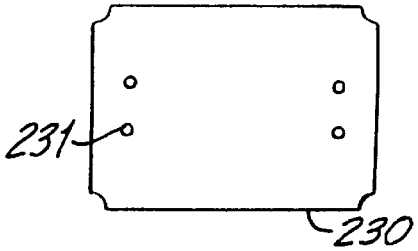
FIG. 6*a* is the top view of the third substrate layer of a multilayer structure for a quadrature 3 dB coupler.
Figure 6B:
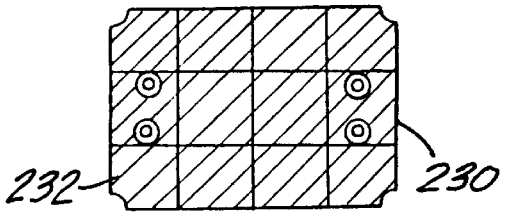
FIG. 6*b* is the bottom view of the third substrate layer of a multilayer structure for a quadrature 3 dB coupler.

With reference to FIGS. 6*a* and 6*b*, the process for manufacturing layer 230 is described. First, four holes each having a diameter of approximately 0.008 inches are drilled into layer 230 as shown in FIGS. 6*a* and 6*b*. Layer 230 is sodium or plasma etched. If sodium etched, layer 230 is cleaned by rinsing in alcohol for 15 to 30 minutes, then preferably rinsing in water, preferably deionized, having a temperature of 70 to 125 degrees F. for at least 15 minutes. Layer 230 is then vacuum baked for approximately 30 minutes to 2 hours at approximately 90 to 180 degrees C., but preferably for one hour at 100 degrees C. Layer 230 is plated with copper, preferably first using an electroless method followed by an electrolytic method, to a thickness of approximately 0.0005 to 0.001 inches, but preferably 0.0007 inches thick. Layer 230 is rinsed in water, preferably deionized, for at least 1 minute. Layer 230 is heated to a temperature of approximately 90 to 125 degrees C. for approximately 5 to 30 minutes, but preferably 90 degrees C. for 5 minutes, and then laminated with photoresist. Masks are used and the photoresist is developed using the proper exposure settings to create the patterns of metal layers 231, 232 shown in FIGS. 6*a* and 6*b*. Both sides of layer 230 are copper etched. Layer 230 is cleaned by rinsing in alcohol for 15 to 30 minutes, then preferably rinsing in water, preferably deionized, having a temperature of 70 to 125 degrees F. for at least 15 minutes. Layer 230 is then vacuum baked for approximately 30 minutes to 2 hours at approximately 90 to 180 degrees C., but preferably for one hour at 149 degrees C.

d. Layer 240

Figure 7A:
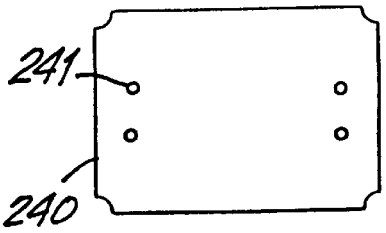
FIG. 7*a* is the top view of the fourth substrate layer of a multilayer structure for a quadrature 3 dB coupler.
Figure 7B:
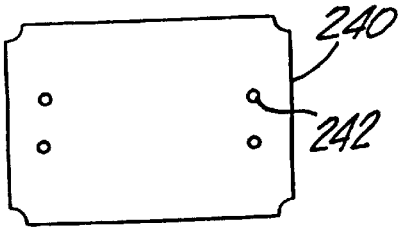
FIG. 7*b* is the bottom view of the fourth substrate layer of a multilayer structure for a quadrature 3 dB coupler.

With reference to FIGS. 7*a* and 7*b*, the process for manufacturing layer 240 is described. First, four holes each having a diameter of approximately 0.008 inches are drilled into layer 240 as shown in FIGS. 7*a* and 7*b*. Layer 240 is sodium or plasma etched. If sodium etched, layer 240 is cleaned by rinsing in alcohol for 15 to 30 minutes, then preferably rinsing in water, preferably deionized, having a temperature of 70 to 125 degrees F. for at least 15 minutes. Layer 240 is then vacuum baked for approximately 30 minutes to 2 hours at approximately 90 to 180 degrees C., but preferably for one hour at 100 degrees C. Layer 240 is plated with copper, preferably first using an electroless method followed by an electrolytic method, to a thickness of approximately 0.0005 to 0.001 inches, but preferably 0.0007 inches thick. Layer 240 is rinsed in water, preferably deionized, for at least 1 minute. Layer 240 is heated to a temperature of approximately 90 to 125 degrees C. for approximately 5 to 30 minutes, but preferably 90 degrees C. for 5 minutes, and then laminated with photoresist. Masks are used and the photoresist is developed using the proper exposure settings to create the patterns of metal layers 241, 242 shown in FIGS. 7*a* and 7*b*. Both sides of layer 240 are copper etched. Layer 240 is cleaned by rinsing in alcohol for 15 to 30 minutes, then preferably rinsing in water, preferably deionized, having a temperature of 70 to 125 degrees F. for at least 15 minutes. Layer 240 is then vacuum baked for approximately 30 minutes to 2 hours at approximately 90 to 180 degrees C., but preferably for one hour at 149 degrees C.

e. Layer 250

Figure 8A:
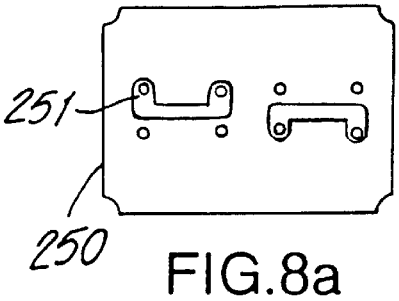
FIG. 8*a* is the top view of the fifth substrate layer of a multilayer structure for a quadrature 3 dB coupler.
Figure 8B:
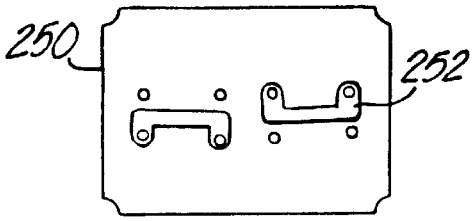
FIG. 8*b* is the bottom view of the fifth substrate layer of a multilayer structure for a quadrature 3 dB coupler.

With reference to FIGS. 8*a* and 8*b*, the process for manufacturing layer 250 is described. First, eight holes each having a diameter of approximately 0.008 inches are drilled into layer 250 as shown in FIGS. 8*a* and 8*b*, and in greater detail in FIG. 13. Layer 250 is sodium or plasma etched. If sodium etched, layer 250 is cleaned by rinsing in alcohol for 15 to 30 minutes, then preferably rinsing in water, preferably deionized, having a temperature of 70 to 125 degrees F. for at least 15 minutes. Layer 250 is then vacuum baked for approximately 30 minutes to 2 hours at approximately 90 to 180 degrees C., but preferably for one hour at 100 degrees C. Layer 250 is plated with copper, preferably first using an electroless method followed by an electrolytic method, to a thickness of approximately 0.0005 to 0.001 inches, but preferably 0.0007 inches thick. Layer 250 is rinsed in water, preferably deionized, for at least 1 minute. Layer 250 is heated to a temperature of approximately 90 to 125 degrees C. for approximately 5 to 30 minutes, but preferably 90 degrees C. for 5 minutes, and then laminated with photoresist. Masks are used and the photoresist is developed using the proper exposure settings to create the patterns of metal layers 251, 252 shown in FIGS. 8*a* and 8*b*, and in greater detail in FIG. 13. Both sides of layer 250 are copper etched. Layer 250 is cleaned by rinsing in alcohol for 15 to 30 minutes, then preferably rinsing in water, preferably deionized, having a temperature of 70 to 125 degrees F. for at least 15 minutes. Layer 250 is then vacuum baked for approximately 30 minutes to 2 hours at approximately 90 to 180 degrees C., but preferably for one hour at 149 degrees C.

f. Layer 260

Figure 9A:
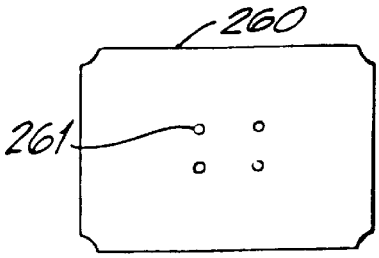
FIG. 9*a* is the top view of the sixth substrate layer of a multilayer structure for a quadrature 3 dB coupler.
Figure 9B:
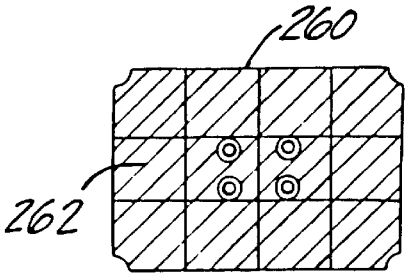
FIG. 9*b* is the bottom view of the sixth substrate layer of a multilayer structure for a quadrature 3 dB coupler.

With reference to FIGS. 9*a* and 9*b*, the process for manufacturing layer 260 is described. First, four holes each having a diameter of approximately 0.008 inches are drilled into layer 260 as shown in FIGS. 9*a* and 9*b*. Layer 260 is sodium or plasma etched. If sodium etched, layer 260 is cleaned by rinsing in alcohol for 15 to 30 minutes, then preferably rinsing in water, preferably deionized, having a temperature of 70 to 125 degrees F. for at least 15 minutes. Layer 260 is then vacuum baked for approximately 30 minutes to 2 hours at approximately 90 to 180 degrees C., but preferably for one hour at 100 degrees C. Layer 260 is plated with copper, preferably first using an electroless method followed by an electrolytic method, to a thickness of approximately 0.0005 to 0.001 inches, but preferably 0.0007 inches thick. Layer 260 is rinsed in water, preferably deionized, for at least 1 minute. Layer 260 is heated to a temperature of approximately 90 to 125 degrees C. for approximately 5 to 30 minutes, but preferably 90 degrees C. for 5 minutes, and then laminated with photoresist. Masks are used and the photoresist is developed using the proper exposure settings to create the patterns of metal layers 261, 262 shown in FIGS. 9*a* and 9*b*. Both sides of layer 260 are copper etched. Layer 260 is cleaned by rinsing in alcohol for 15 to 30 minutes, then preferably rinsing in water, preferably deionized, having a temperature of 70 to 125 degrees F. for at least 15 minutes. Layer 260 is then vacuum baked for approximately 30 minutes to 2 hours at approximately 90 to 180 degrees C., but preferably for one hour at 149 degrees C.

g. Layer 270

Figure 10A:
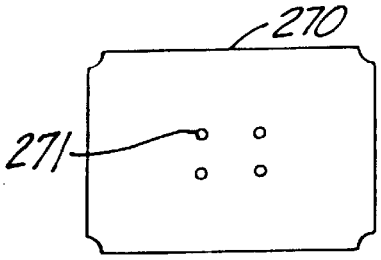
FIG. 10*a* is the top view of the seventh substrate layer of a multilayer structure for a quadrature 3 dB coupler.
Figure 10B:
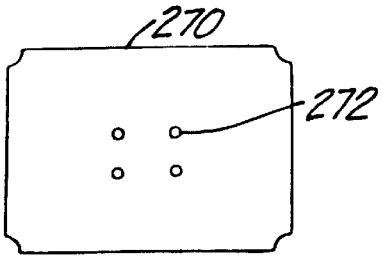
FIG. 10*b* is the bottom view of the seventh substrate layer of a multilayer structure for a quadrature 3 dB coupler.

With reference to FIGS. 10*a* and 10*b*, the process for manufacturing layer 270 is described. First, four holes each having a diameter of approximately 0.008 inches are drilled into layer 270 as shown in FIGS. 10*a* and 10*b*. Layer 270 is sodium or plasma etched. If sodium etched, layer 270 is cleaned by rinsing in alcohol for 15 to 30 minutes, then preferably rinsing in water, preferably deionized, having a temperature of 70 to 125 degrees F. for at least 15 minutes. Layer 270 is then vacuum baked for approximately 30 minutes to 2 hours at approximately 90 to 180 degrees C., but preferably for one hour at 100 degrees C. Layer 270 is plated with copper, preferably first using an electroless method followed by an electrolytic method, to a thickness of approximately 0.0005 to 0.001 inches, but preferably 0.0007 inches thick. Layer 270 is rinsed in water, preferably deionized, for at least 1 minute. Layer 270 is heated to a temperature of approximately 90 to 125 degrees C. for approximately 5 to 30 minutes, but preferably 90 degrees C. for 5 minutes, and then laminated with photoresist. Masks are used and the photoresist is developed using the proper exposure settings to create the patterns of metal layers 271, 272 shown in FIGS. 10*a* and lob. Both sides of layer 270 are copper etched. Layer 270 is cleaned by rinsing in alcohol for 15 to 30 minutes, then preferably rinsing in water, preferably deionized, having a temperature of 70 to 125 degrees F. for at least 15 minutes. Layer 270 is then vacuum baked for approximately 30 minutes to 2 hours at approximately 90 to 180 degrees C., but preferably for one hour at 149 degrees C.

h. Layer 280

With reference to FIGS. 11*a* and 11*b*, the process for manufacturing layer 280 is described. First, eight holes each having a diameter of approximately 0.008 inches and four corner holes each having a diameter of 0.031 inches are drilled into layer 280 as shown in FIGS. 11*a* and 11*b*, and in greater detail in FIG. 12. Layer 280 is sodium or plasma etched. If sodium etched, layer 280 is cleaned by rinsing in alcohol for 15 to 30 minutes, then preferably rinsing in water, preferably deionized, having a temperature of 70 to 125 degrees F. for at least 15 minutes. Layer 280 is then vacuum baked for approximately 30 minutes to 2 hours at approximately 90 to 180 degrees C., but preferably for one hour at 100 degrees C. Layer 280 is plated with copper, preferably first using an electroless method followed by an electrolytic method, to a thickness of approximately 0.0005 to 0.001 inches, but preferably 0.0007 inches thick. Layer 280 is rinsed in water, preferably deionized, for at least 1 minute. Layer 280 is heated to a temperature of approximately 90 to 125 degrees C. for approximately 5 to 30 minutes, but preferably 90 degrees C. for 5 minutes, and then laminated with photoresist. A mask is used and the photoresist is developed using the proper exposure settings to create the pattern of metal layer 281 shown in FIG. 11*a* and in greater detail in FIG. 12. The top side of layer 280 is copper etched. Layer 280 is cleaned by rinsing in alcohol for 15 to 30 minutes, then preferably rinsing in water, preferably deionized, having a temperature of 70 to 125 degrees F. for at least 15 minutes. Layer 280 is then vacuum baked for approximately 30 minutes to 2 hours at approximately 90 to 180 degrees C., but preferably for one hour at 149 degrees C.

i. Final Assembly

After layers 210, 220, 230, 240, 250, 260, 270, 280 have been processed using the above procedure, they are fusion bonded together into multilayer assembly 200.

Although bonding pressure typically varies from approximately 100 PSI to approximately 1000 PSI and bonding temperature typically varies from approximately 350 degrees C. to 450 degrees C., an example of a profile is 200 PSI, with a 40 minute ramp from room temperature to 240 degrees C., a 45 minute ramp to 375 degrees C., a 15 minutes dwell at 375 degrees C., and a 90 minute ramp to 35 degrees C.

Four slots having diameters of approximately 0.031 inches are drilled along the ground perimter as shown in FIG. 11*b*. Multilayer assembly 200 is sodium or plasma etched. If sodium etched, then multilayer assembly 200 is cleaned by rinsing in alcohol for 15 to 30 minutes, then preferably rinsing in water, preferably deionized, having a temperature of 70 to 125 degrees F. for at least 15 minutes. Multilayer assembly 200 is then vacuum baked for approximately 45 to 90 minutes at approximately 90 to 125 degrees C., but preferably for one hour at 100 degrees C. Multilayer assembly 200 is plated with copper, preferably first using an electroless method followed by an electrolytic method, to a thickness of approximately 0.0005 to 0.001 inches, but preferably to a thickness of approximately 0.0007 inches. Multilayer assembly 200 is rinsed in water, preferably deionized, for at least 1 minute. Multilayer assembly 200 is heated to a temperature of approximately 90 to 125 degrees C. for approximately 5 to 30 minutes, but preferably 90 degrees C. for 5 minutes, and then laminated with photoresist. A mask is used and the photoresist is developed using the proper exposure settings to create the pattern of metal layer 282 shown in FIG. 11*b*. The bottom side of multilayer assembly 200 is copper etched. Multilayer assembly 200 is cleaned by rinsing in alcohol for 15 to 30 minutes, then preferably rinsing in water, preferably deionized, having a temperature of 70 to 125 degrees F. for at least 15 minutes. Multilayer assembly 200 is plated with tin and lead, then the tin/lead plating is heated to the melting point to allow excess plating to reflow into a solder alloy. Multilayer assembly 200 is cleaned by rinsing in alcohol for 15 to 30 minutes, then preferably rinsing in water, preferably deionized, having a temperature of 70 to 125 degrees F. for at least 15 minutes.

Multilayer assembly 200 is de-paneled using a depaneling method, which may include drilling and milling, diamond saw, and/or EXCIMER laser. Multilayer assembly 200 is cleaned by rinsing in alcohol for 15 to 30 minutes, then preferably rinsing in water, preferably deionized, having a temperature of 70 to 125 degrees F. for at least 15 minutes. Multilayer assembly 200 is then vacuum baked for approximately 30 minutes to 2 hours at approximately 90 to 180 degrees C., but preferably for one hour at 149 degrees C.

IV. Manufacture of Other Preferred Embodiments

Although the manufacture of one preferred embodiment has been presented through the example of the quadrature 3 dB coupler of multilayer assembly 200, it is obvious to those of ordinary skill in the art that other circuits may be manufactured by altering the above manufacturing process in an obvious manner. Thus, the following sections will discuss the operation of various embodiments of the invention. It should be noted, however, that in a preferred embodiment for the directional 10 dB coupler of multilayer assembly 300, the substrate layers with somewhat different properties may be selected.

Substrate layers 310, 320, 330, 340, 350, 360 are approximately 0.280 inches in the x-direction, approximately 0.200 inches in the y-direction, and have an Er of approximately 6.15. Substrate layers 370, 380 are also approximately 0.280 inches in the x-direction and approximately 0.200 inches in the y-direction, but have an Er of approximately 3.0. Substrate layers 310, 330, 340, 360, 370, 380 have an approximate thickness of 0.015, while substrate layers 320 and 350 have an approximate thickness of 0.005. The dimensions of these layers are based upon the theoretical equations of the references referred to below.

V. Operation of Some Preferred Embodiments Implementing Classic Couplers in Multilayer The theory of operation for couplers constructed in a multilayer, vertically-connected stripline architecture is similar to that of traditional couplers. Therefore, a brief description of traditional couplers and illustrations of their implementation in the multilayer, vertically-connected stripline architecture of the present invention will allow those of ordinary skill in the art of designing couplers to implement a large variety of couplers in accordance with the invention.

The theory of operation of traditional couplers are well known to those of ordinary skill in the art of microwave coupler design. For example, the theory of operation for directional couplers and quadrature 3 dB couplers may be found in classic references, such as Cohn, S. B., "Shielded Coupled-Strip Transmission Line", *IEEE Trans. MTT-S,* Vol. MTT-3, No. 5, October 1955, pp. 29–38; Cohn, S. B., "Characteristic Impedances of Broadside-Coupled Strip Transmission Lines", *IRE Trans. MTT-S,* Vol. MTT-8, No. 6, November 1960, pp. 633–637; Shelton, Jr., J. P., "Impedances of Offset Parallel-Coupled Strip Transmission Lines", *IEEE Trans. MTT-S,* Vol. MTT-14, No. 1, January 1966, pp. 7–15. Various cross sections of stripline couplers described in these references are shown in FIGS. 15, 16, 17, 18.

Figure 15:
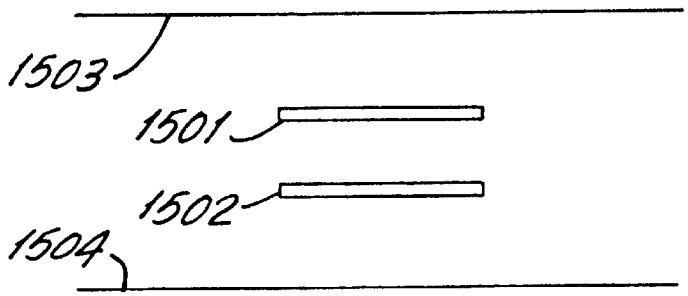
FIG. 15 is the end view of an example of broadside coupled striplines.

Quadrature couplers are typically implemented as broadside-coupled stripline, as shown in FIG. 15. In this embodiment, metal lines 1501, 1502, which are separated by a dielectric layer and are also separated from groundplanes 1503, 1504 by dielectric layers, are parallel to each other in the Z-direction and overlap substantially completely.

Figure 16:
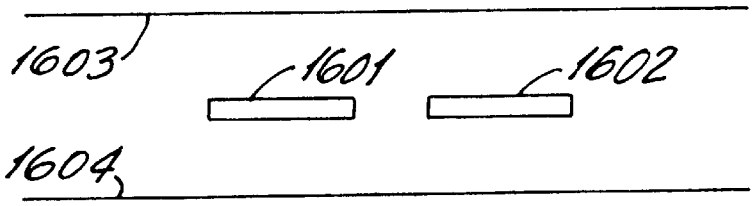
FIG. 16 is the end view of an example of edge coupled striplines.
Figure 17:
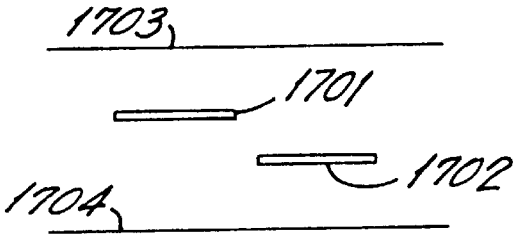
FIG. 17 is the end view of an example of offset oupled striplines with a gap.
Figure 18:
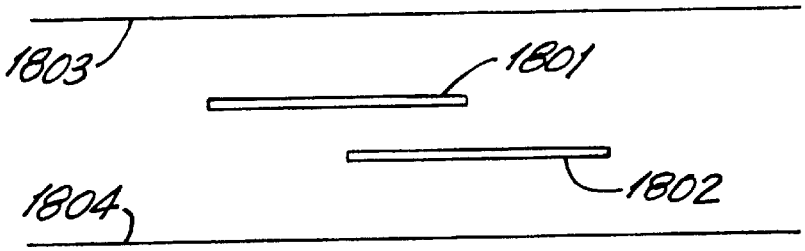
FIG. 18 is the end view of an example of offset coupled striplines with overlay.

Directional couplers are often implemented as edge-coupled stripline, as shown in FIG. 16. In this embodiment, metal lines 1601, 1602, are parallel to each other in the X-direction and/or Y-direction, and are separated from groundplanes 1603, 1604 by dielectrics. Directional couplers may also be implemented as offset-coupled stripline, as shown in two different embodiments in FIGS. 17 and 18. In FIG. 17, metal lines 1701, 1702 are offset coupled with a gap (that is, they do not overlap in the Z-direction), are separated by a dielectric, and are also separated from groundplanes 1703, 1704 by dielectrics. In FIG. 18, metal lines 1801, 1802 are offset coupled with overlay (that is, they partially overlap in the Z-direction, are separated by a dielectric, and are also separated from groundplanes 1803, 1804 by dielectrics.

Figure 19:
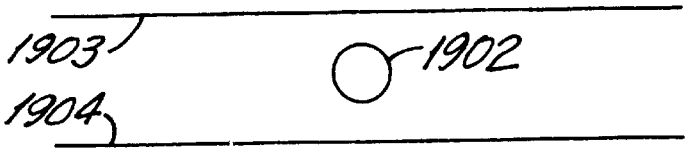
FIG. 19 is the top view of an example of a slabline transmission line.
Figure 23A:
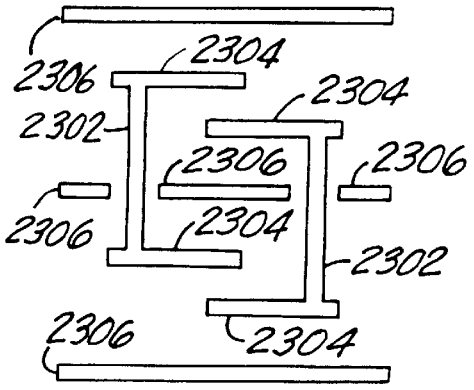
FIG. 23*a* is the end view of an example of stripline connected by via holes.
Figure 23B:
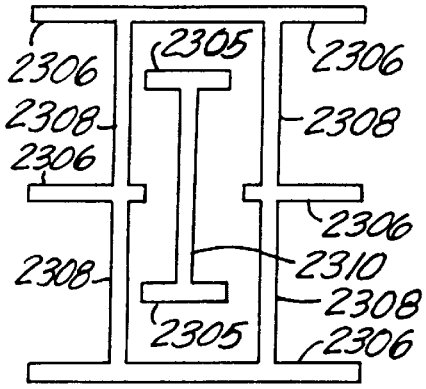
FIG. 23*b* is the side view of an example of stripline connected by slabline connections.

This invention teaches that the couplers disclosed above, as well as their permutations, may be broken into segments, and these segments may be stacked in a multilayer, vertically-connected stripline assembly. The segments may be connected by via holes, which are utilized in the quadrature 3 dB coupler disclosed above and are also shown as signal via holes 2302 in FIG. 23*a*. Alternatively, vertical slabline transmission lines, such as the one shown in FIG. 19 comprising via hole 1902 separated from ground 1903, 1904 by dielectric material, may be used to connect segments. An example of a slabline transmission line being used to connect coupler segments is shown in FIG. 23*b*, where stripline 2305 is connected by via hole 2310 interspersed between ground via holes 2308. Vertical slabline transmission lines formed according to Gunston, M. A. R., *Microwave Transmission Line Impedance Data,* Van Nostrand Reinhold Co., 1971, pp. 63–82 may be used to provide controlled impedance interconnections in the Z-direction.

Figure 12:
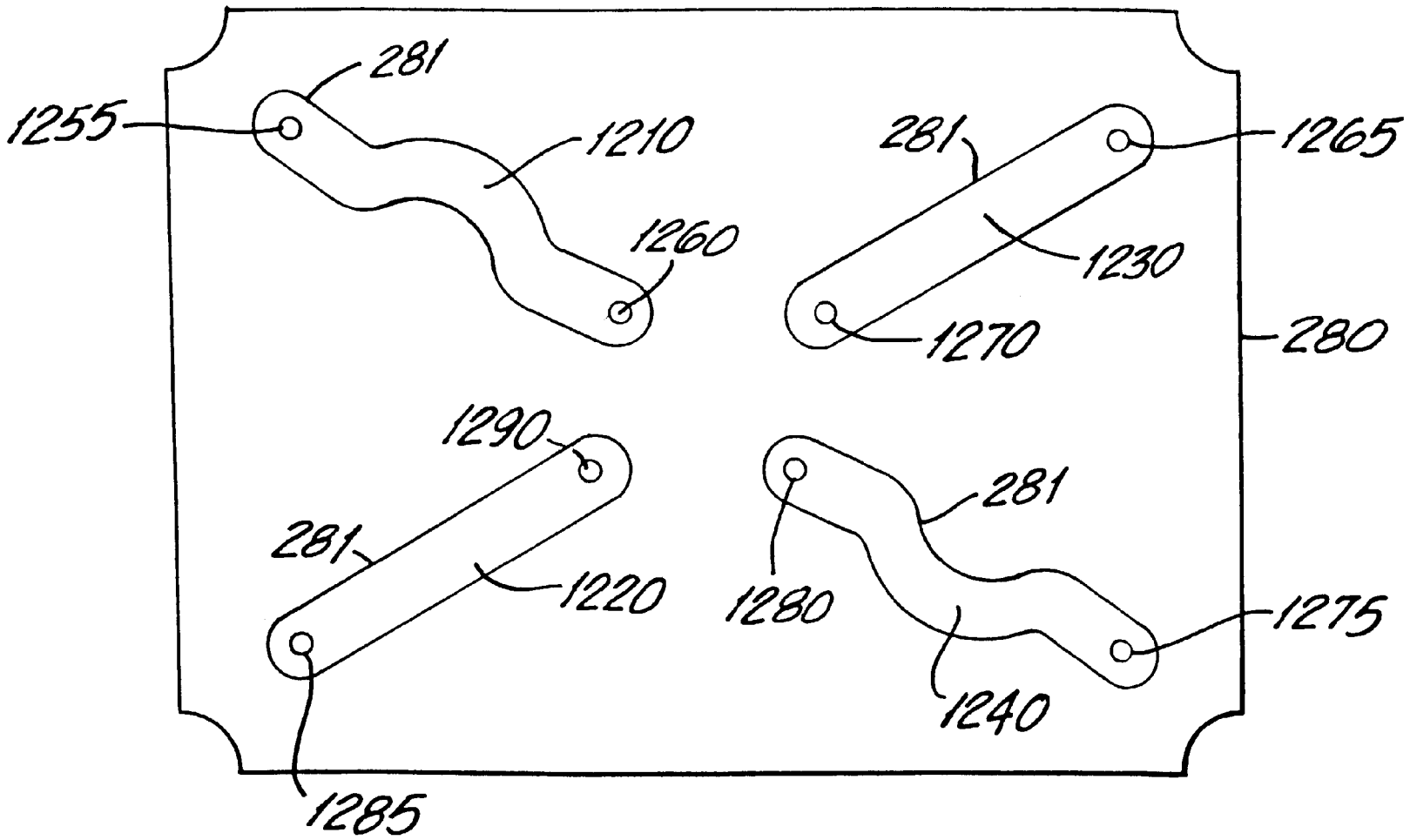
FIG. 12 is a detailed top view of the eighth substrate layer of a multilayer structure for a quadrature 3 dB coupler.
Figure 13:
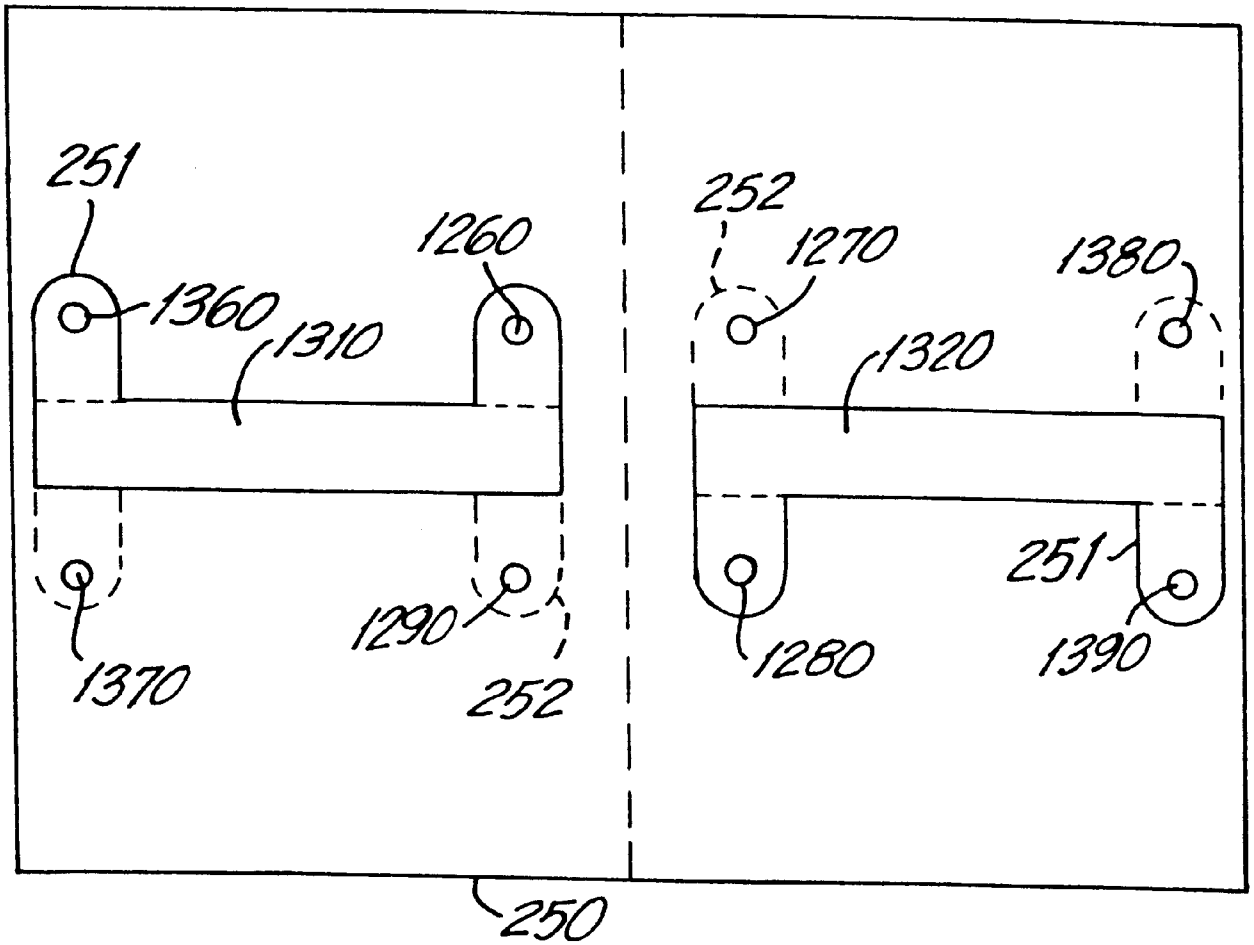
FIG. 13 is a detailed top view of the fifth substrate layer of a multilayer structure for a quadrature 3 dB coupler with an outline of the metal layer on the bottom of the fifth substrate layer.
Figure 14:
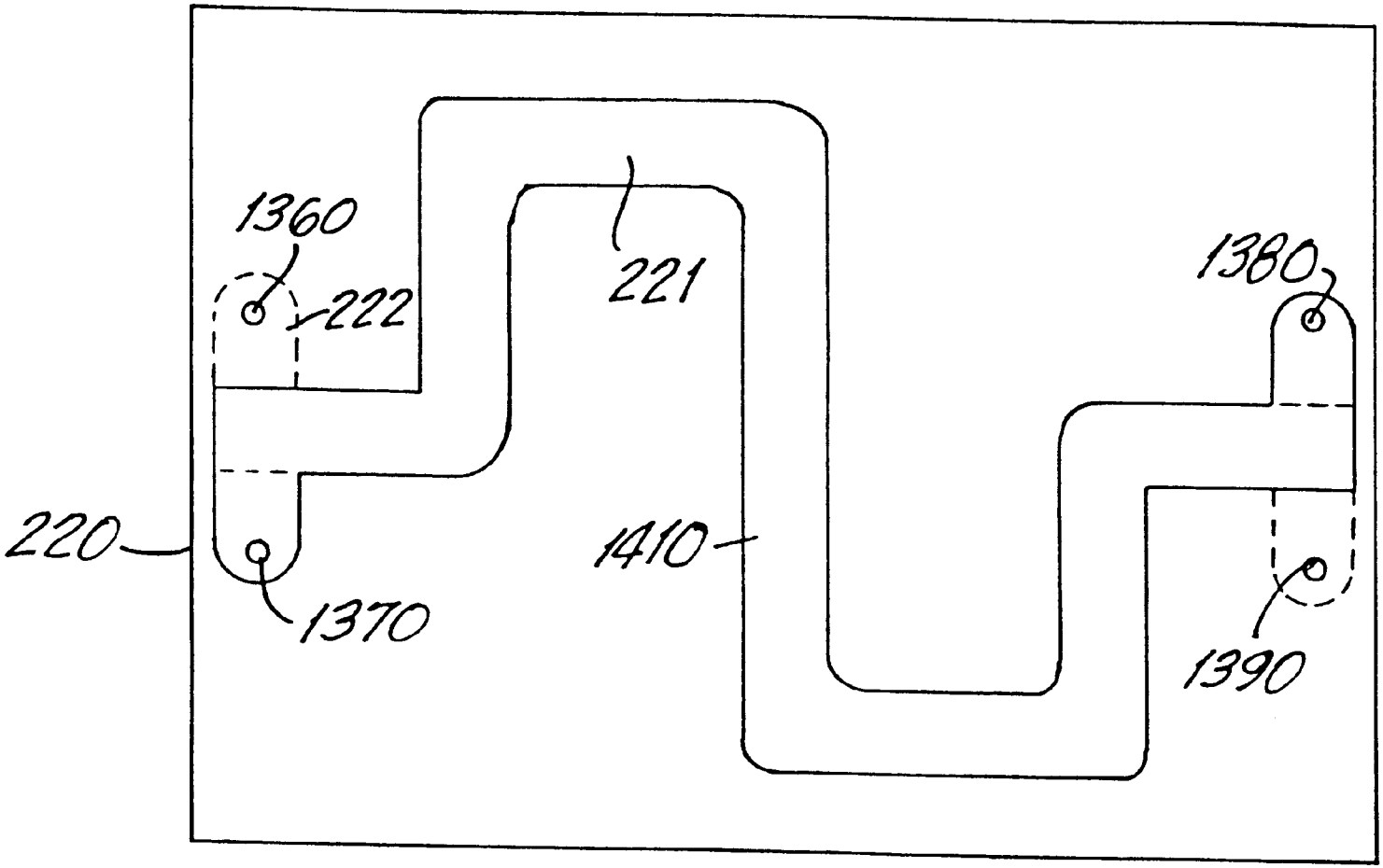
FIG. 14 is a detailed top view of the second substrate layer of a multilayer structure for a quadrature 3 dB coupler with an outline of the metal layer on the bottom of the fifth substrate layer.

Returning to the preferred embodiment disclosed above for a quadrature 3 dB coupler, the coupler segments shown in FIGS. 12, 13, and 14 illustrate how a coupler is broken into segments. A vertically-connected stack of coupled stripline segments is used to split a coupler into segments 1310, 1320, 1410, each approximately 18.5 mils wide. Stripline transmission line 1210, which is approximately 18.5 mils wide and has a bend to add 5 mils to its length, stripline transmission line 1220, which is approximately 18.5 mils wide, stripline transmission line 1230, which is approximately 18.5 mils wide, and stripline transmission line 1240, which is approximately 18 mils wide and has a bend to add 5 mils to its length, are used to route signals in and out of the coupler and maintain a desirable input/output impedance. Via holes 1255, 1260, 1265, 1270, 1275, 1280, 1285, 1290, 1360, 1370, 1380, 1390 are used to interconnect coupler segments 1310, 1320, 1410 and stripline transmission lines 1210, 1220, 1230, 1240.

Referring to multilayer structure 200, it is apparent that in this embodiment, eight substrate layers are used to form three sets of stripline. Substrate layers 210, 220, 230 are bounded by groundplanes on metal layers 211, 232. Substrate layers 240, 250, 260 are bounded by groundplanes on metal layers 232, 262. Substrate layers 270, 280 are bounded by groundplanes on metal layers 262, 282. Coupler segment 1410 is located on metal layers 221, 222. Coupler segments 1310, 1320 are located on metal layers 251, 252. Stripline transmission lines 1210, 1220, 1230, 1240 are located on metal layer 281. A signal incident on transmission line 1210 would be coupled to transmission line 1220, isolated from transmission line 1230, and would find a direct transmission path to transmission line 1240. Similarly, a signal incident on transmission line 1220 would be coupled to transmission line 1210, isolated from transmission line 1240, and would find a direct transmission path to transmission line 1230. A signal incident on transmission line 1230 would be coupled to transmission line 1240, isolated from transmission line 1210, and would find a direct transmission path to transmission line 1220. A signal incident on transmission line 1240 would be coupled to transmission line 1230, isolated from transmission line 1220, and would find a direct transmission path to transmission line 1210.

For another example illustrating how a traditional stripline coupler may be segmented and implemented in a vertically-connected stripline structure, refer to the conventional edge-coupled stripline coupler shown in FIG. 26. The conventional edge-coupled stripline coupler comprises transmission lines 2601, 2602, 2603, 2604, which are interface connections for the four ports of the coupler and coupled section 2609, 2610. Coupled section 2609, 2610 can be segmented at nodes 2611, 2612, 2613, 2614 into first coupled segment 2609*a*, 2610*a*, second coupled segment 2609*b*, 2610*b*, and third coupled segment 2609*c*, 2610*c*. A typical preferred embodiment for implementing this device in a vertically-connected stripline structure is shown in FIGS. 27*a*, 27*b*, 27*c*, 27*d*. The embodiment shown in FIGS. 27*a*, 27*b*, 27*c*, 27*d* segments the conventional edge-coupled stripline coupler into two node planes, namely node plane 2711, 2712 and node plane 2713, 2714. First coupled segment 2609*a*, 2610*a* is situated between groundplane 2751 and groundplane 2752. Second coupled segment 2609*b*, 2610*b* is situated between groundplane 2752 and groundplane 2753. Third coupled segment 2609*c*, 2610*c* is situated between groundplane 2753 and groundplane 2754. Transmission lines 2601, 2602 are situated between groundplanes 2751, 2752, while transmission lines 2603, 2604 are situated between groundplanes 2753, 2754. Those of ordinary skill in the art may similarly also implement the stripline couplers of FIGS. 15, 17, and 18 as vertically-connected stripline structures.

VI. Operation of Some Preferred Embodiments Implementing Wideband Couplers in Multilayer Wide bandwidth directional couplers are often designed using the formulas and tables found in Levy, R., "General Synthesis Of Asymmetric Multi-Element Coupled-Transmission-Line Directional Couplers", *IEEE Trans. MTT-S,* Vol. MTT-11, No. 4, July 1963, pp. 226–23, and Levy, R., "Tables for Asymmetric Multi-Element Coupled-Transmission-Line Directional Couplers", *IEEE Trans. MTT-S,* Vol. MTT-12, No. 3, May 1964, pp. 275–279. Vertically-connected stripline architecture may be used to stack multiple coupled line sections and interconnect them in the Z-direction, thereby greatly reducing the area of the coupler in the X-Y-plane.

Wide bandwidth quadrature couplers are often designed using the tables found in Cristal, E. G., Young, L., "Theory and Tables Of Optimum Symmetrical TEM-Mode Coupled-Transmission-Line Directional Couplers", *IEEE Trans. MTT-S,* Vol. MTT-13, No. 5, September 1965, pp. 544–558. Alternatively, U.S. Pat. No. 3,761,843 to Cappucci for "Four Port Networks Synthesized From Interconnection Of Coupled and Uncoupled Sections Of Line Lengths" explains how to synthesize wide bandwidth couplers from a series of coupled and uncoupled striplines, for example by combining a series of uncoupled interconnections with a series of coupled lines to form a broad bandwidth quadrature coupler.

Similarly, non-uniform coupled structures, such as those defined by Tresselt, C. P., "The Design and Construction of Broadband, High Directivity, 90-Degree Couplers Using Nonuniform Line Techniques", *IEEE Trans. MTT-S,* Vol. MTT-14, No. 12, December 1966, pp. 647–656, and Tresselt, C. P., "The Design and Computer Performance Of Three Classes of Equal-Ripple Nonuniform Line Couplers", *IEEE Trans. MTT-S,* No. 4, April 1969, pp. 218–230, may also be stacked and connected in tandem, vertically, to provide a coupler capable of operating over a very wide range of frequencies and having a high pass frequency response.

Referring to FIG. 21, a traditional three-section symmetrical coupler is shown. The coupler comprises transmission lines 2121, 2122, 2123, 2124, which are interface connections for the four ports of the coupler and a first coupled section 2131, 2132, second coupled section 2133, 2134, and third coupled section 2135, 2136. Nodes 2125, 2128 are connected between transmission lines 2121, 2122, respectively, and first coupled section 2131, 2132, while nodes 2137, 2138 are connected between transmission lines 2123, 2124, respectively, and third coupled section 2135, 2136. Nodes 2126, 2129 are connected between first coupled section 2131, 2132 and second coupled section 2133, 2134, while nodes 2127, 2130 are connected between second coupled section 2133, 2134 and third coupled section 2135, 2136. A typical preferred embodiment for implementing this device in a vertically-connected stripline structure is shown in FIGS. 22*a*, 22*b*, 22*c*, 22*d*, 22*e*. The embodiment shown in FIGS. 22*a*, 22*b*, 22*c*, 22*d*, 22*e* segments the three-section symmetrical coupler into four node planes, namely node plane 2225, 2228, node plane 2226, 2229, node plane 2227, 2230, and node plane 2237, 2238. First coupled section 2131, 2132 is situated between groundplane 2253 and groundplane 2254. Second coupled section 2133, 2134 is situated between groundplane 2252 and groundplane 2253. Third coupled section 2135, 2136 is situated between groundplane 2251 and groundplane 2252. Transmission lines 2121, 2122, 2123, 2124 are situated between groundplane 2254 and groundplane 2255. Each one of nodes 2125, 2126, 2127, 2128, 2129, 2130, 2137, 2138 is replaced by a via hole connection in a preferred embodiment or other conducting means, such as slabline connections, in alternative preferred embodiments. For example, it is obvious to those of ordinary skill in the art that node 2137 may be connected by a first via hole interconnection and node 2138 may be connected by a second via hole interconnection, wherein both via hole connections are in node plane 2237, 2238. An example of using via hole connections is illustrated in FIG. 23*a* and the accompanying text. It is also obvious to those of ordinary skill in the art that a coupler may be implemented using various types of coupling for striplines, such as broadside coupling, offset coupling with a gap, and offset coupling with overlay, as illustrated in FIGS. 15, 17, and 18, for vertically-connected stripline structures.

It is also obvious to those of ordinary skill in the art that a vertically-connected stripline structure may also be used to implement an asymmetric coupler, such as the asymmetrical four-section coupler illustrated in FIG. 20.

Figure 28:
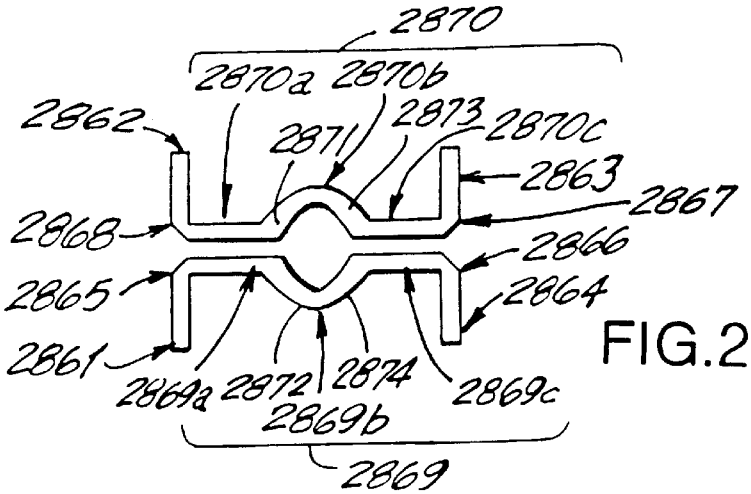
FIG. 28 is the top view of a coupler composed of a series of coupled and uncoupled striplines implemented with a conventional stripline configuration.

Referring to FIG. 28, a Cappucci coupler (a series of uncoupled interconnections combined with a series of coupled lines to form a broad bandwidth quadrature coupler) is shown. The coupler comprises transmission lines 2861, 2862, 2863, 2864, which are interface connections for the four ports of the coupler and a coupled-uncoupled-coupled line combination 2869, 2870. Coupled-uncoupled-coupled line combination 2869, 2870 may be sectioned into a first coupled section 2869*a*, 2870*a*, an uncoupled section 2869*b*, 2870*b*, and a second coupled section 2869*c*, 2870*c*. Nodes 2871, 2872 are connected between first coupled section 2869*a*, 2870*a* and uncoupled section 2869*b*, 2870*b*, while nodes 2873, 2874 are connected between uncoupled section 2869*b*, 2870*b* and second coupled section 2869*c*, 2870*c*.

Figure 29A:
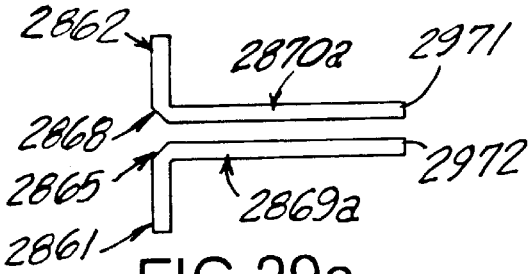
FIG. 29*a* is the representative view of a first segment of a coupler composed of a series of coupled and uncoupled striplines implemented with a vertically-connected stripline configuration.
Figure 29B:
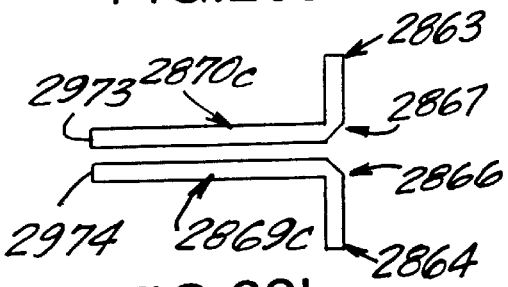
FIG. 29*b* is the representative view of a second segment of a coupler composed of a series of coupled and uncoupled striplines implemented with a vertically-connected stripline configuration.
Figure 29C:
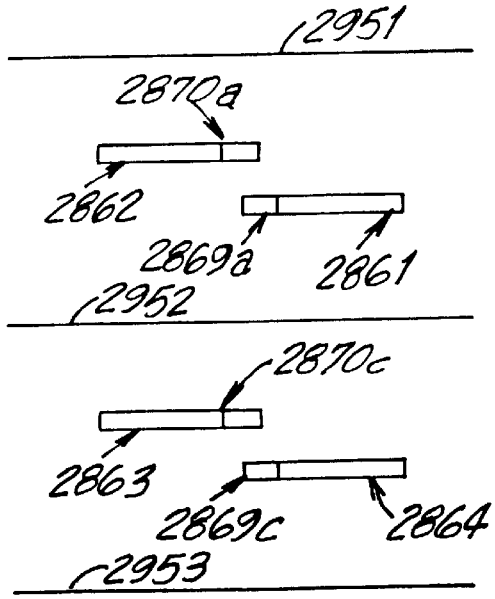
FIG. 29*c* is the end view of a coupler composed of a series of coupled and uncoupled striplines implemented with a vertically-connected stripline configuration.

A typical preferred embodiment for implementing this device in a vertically-connected stripline structure is shown in FIGS. 29*a*, 29*b*, 29*c*. The embodiment shown in FIGS. 29*a*, 29*b*, 29*c* segments the Cappucci coupler into two node planes, namely node plane 2971, 2972 and node plane 2973, 2974. First coupled section 2869*a*, 2870*a* and transmission lines 2861, 2862 are situated between groundplane 2951 and groundplane 2952. Second coupled section 2869*c*, 2870*c* and transmission lines 2863, 2864 are situated between groundplane 2952 and groundplane 2953. Each one of nodes 2871, 2872, 2873, 2874 is replaced by a via hole connection in a preferred embodiment or other conducting means, such as slabline connections, in alternative preferred embodiments, in a manner that is obvious to those of ordinary skill in the art. Furthermore, in a preferred embodiment, node 2871 is connected to node 2873 using a first via hole interconnection and node 2872 is connected to node 2874 using a second via hole interconnection, thereby forming uncoupled section 2869*b*, 2870*b* using via holes.

Figure 24:
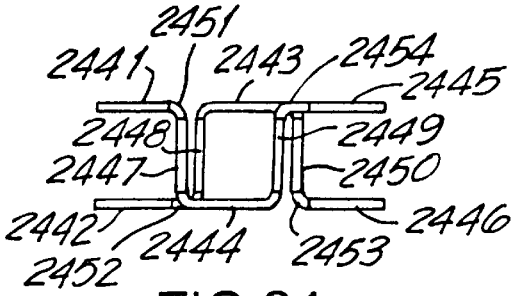
FIG. 24 is the top view of an example of tandem connection of directional couplers implemented with a conventional stripline configuration.
Figure 25A:
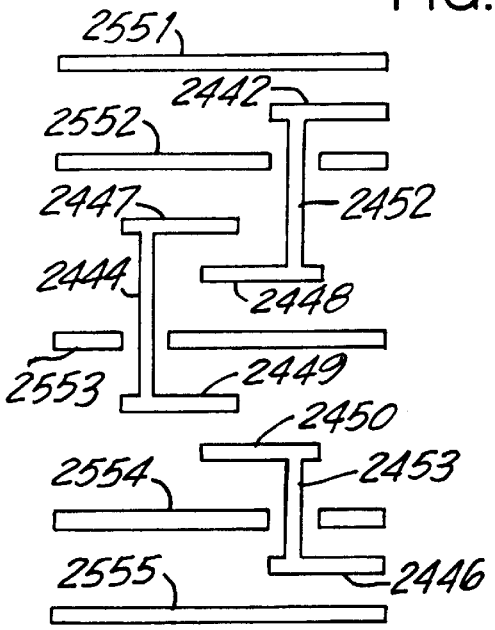
FIG. 25*a* is the right end view of an example of tandem connection of directional couplers implemented with a vertically-connected stripline configuration.
Figure 25B:
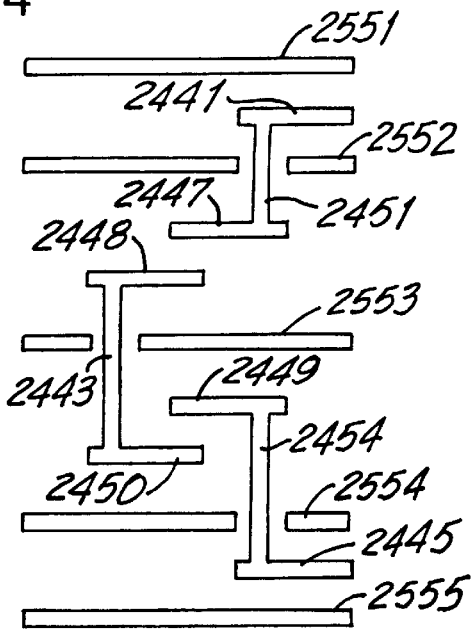
FIG. 25*b* is the left end view of an example of tandem connection of directional couplers implemented with a vertically-connected stripline configuration.

Referring to FIG. 24, a directional coupler comprising tandem-connection coupled striplines is shown. The coupler comprises transmission lines 2441, 2442, 2445, 2446, which are interface connections for the four ports of the coupler and a first coupled section 2447, 2448, a second coupled section 2449, 2450, and transmission lines 2443, 2444. Transmission lines 2443, 2444 connect first coupled section 2447, 2448 and second coupled section 2449, 2450. Nodes 2451, 2452 are connected between transmission lines 2443, 2444, respectively, and first coupled section 2447, 2448, while nodes 2453, 2454 are connected between transmission lines 2444, 2443, respectively, and second coupled section 2449, 2450. A typical preferred embodiment for implementing this device in a vertically-connected stripline structure is shown in FIGS. 25*a*, 25*b*. The embodiment shown in FIGS. 25*a*, 25*b* segments the tandem-connected coupler into four node planes. The tandem-connected coupler is segmented between coupled sections 2447, 2448, 2449, 2450 and transmission lines 2443, 2444, and also between coupled sections 2447, 2448, 2449, 2450 and nodes 2451, 2452, 2453, 2454, and also between nodes 2451, 2452, 2453, 2454 and transmission lines 2441, 2442, 2445, 2446. First coupled section 2447, 2448 is situated between groundplane 2552 and groundplane 2553. Second coupled section 2449, 2450 is situated between groundplane 2553 and groundplane 2554. Transmission lines 2441, 2442 are situated between groundplane 2551 and groundplane 2552. Transmission lines 2445, 2446 are situated between groundplane 2554 and groundplane 2555. Each one of nodes 2451, 2452, 2453, 2454 is replaced by a via hole connection in a preferred embodiment or other conducting means, such as slabline connections, in alternative preferred embodiments, in a manner that is obvious to those of ordinary skill in the art. In a preferred embodiment, node 2451 is connected to node 2454 using a first via hole interconnection and node 2452 is connected to node 2453 using a second via hole interconnection, thereby forming transmission lines 2443, 2444.

VII. Other Embodiments

It is obvious to those of ordinary skill in the art that many permutations and combinations of couplers constructed in multilayer, vertically-connected stripline architecture as illustrated above exist, and it would be obvious to those of ordinary skill in the art that these permutations and combinations may be implemented without undue experimentation, relying on the illustrations provided. Furthermore, it is obvious to those of ordinary skill in the art that various types of coupling, such as those disclosed herein by example only, may be used in such implementations.

Additionally, while there have been shown and described and pointed out fundamental novel features of the invention as applied to embodiments thereof, it will be understood that various omissions and substitutions and changes in the form and details of the invention, as herein disclosed, may be made by those skilled in the art without departing from the spirit of the invention. It is expressly intended that all combinations of those elements and/or method steps which perform substantially the same function in substantially the same way to achieve the same results are within the scope of the invention. It is the intention, therefore, to be limited only as indicated by the scope of the claims appended hereto.

What is claimed is:

1. A homogeneous multilayer structure comprising:

a plurality of substrate layers defining levels and having surfaces;

a plurality of metal layers disposed on said surfaces of said plurality of substrate layers;

a plurality of groundplanes comprising a first subset of said plurality of metal layers connected by a plurality of transmission line structures; and at least one coupler comprising a plurality of coupler segments, wherein said plurality of coupler segments comprises a second subset of said plurality of metal layers connected by said plurality of transmission line structures, and wherein at least two of said plurality of coupler segments are on different levels.

2. The homogeneous multilayer structure of claim 1, wherein said plurality of substrate layers comprise a polytetrafluoroethylene composite.

3. The homogeneous multilayer structure of claim 1, wherein said plurality of transmission line structures comprises via holes.

4. The homogeneous multilayer structure of claim 1, wherein said at least one coupler has a frequency of operation between approximately 0.5 GHz and approximately 6.0 GHz.

5. The homogeneous multilayer structure of claim 1, wherein said at least one coupler is a wideband coupler.

6. The homogeneous multilayer structure of claim 5, wherein said wideband coupler is a non-uniform coupled structure.

7. The homogeneous multilayer structure of claim 5, wherein said wideband coupler is a Cappucci coupler.

8. A homogeneous multilayer structure comprising:

a plurality of substrate layers defining levels and having surfaces;

a plurality of metal layers disposed on said surfaces of said plurality of substrate layers;

a plurality of groundplanes comprising a first subset of said plurality of metal layers connected by a first plurality of conductors; and at least one coupler comprising a plurality of coupler segments, wherein said plurality of coupler segments comprises a second subset of said plurality of metal layers connected by a second plurality of conductors, and wherein at least two of said plurality of coupler segments are on different levels;

wherein said second plurality of conductors comprises slabline transmission lines.

9. A homogeneous multilayer structure comprising:

substrate means for defining levels and surfaces;

metal layer means disposed on said surfaces to define a plurality of conducting layers;

grounding means comprising a first subset of said plurality of conducting layers;

coupler means comprising a plurality of coupler segment means, wherein said plurality of coupler segment means comprises a second subset of said plurality of conducting layers, and wherein at least two of said plurality of coupler segment means are on different levels; and transmission line means for connecting said grounding means and said coupler segment means.

10. The homogeneous multilayer structure of claim 9, wherein said substrate means comprises a polytetrafluoroethylene composite.

11. The homogeneous multilayer structure of claim 9, wherein said transmission line means comprise via holes means.

12. The homogeneous multilayer structure of claim 9, wherein said coupler means has a frequency of operation between approximately 0.5 GHz and approximately 6.0 GHz.

13. The homogeneous multilayer structure of claim 9, wherein said coupler means is a wideband coupler.

14. The homogeneous multilayer structure of claim 13, wherein said wideband coupler is a non-uniform coupled structure.

15. The homogeneous multilayer structure of claim 13, wherein said wideband coupler is a Cappucci coupler.

16. A homogeneous multilayer structure comprising:

substrate means for defining levels and surfaces;

metal layer means disposed on said surfaces to define a plurality of conducting layers;

grounding means comprising a first subset of said plurality of conducting layers;

first conducting means for connecting said grounding means;

coupler means comprising a plurality of coupler segment means, wherein said plurality of coupler segment means comprises a second subset of said plurality of conducting layers, and wherein at least two of said plurality of coupler segment means are on different levels; and second conducting means for connecting said coupler segment means;

wherein said second conducting means comprises slabline transmission lines.

* * * * *